US010921025B2

(12) United States Patent
Shaffer, Jr. et al.

(10) Patent No.: US 10,921,025 B2
(45) Date of Patent: Feb. 16, 2021

(54) HOT WATER TANK

(71) Applicant: NATIONAL MACHINE COMPANY, Stow, OH (US)

(72) Inventors: Ronald Shaffer, Jr., Stow, OH (US); Samuel Chrisant, Stow, OH (US); Robert William Hyde, Stow, OH (US)

(73) Assignee: NATIONAL MACHINE GROUP, Stow, OH (US)

( * ) Notice: Subject to any disclaimer, the term of this patent is extended or adjusted under 35 U.S.C. 154(b) by 352 days.

(21) Appl. No.: 15/746,329

(22) PCT Filed: Jul. 22, 2016

(86) PCT No.: PCT/US2016/043651
§ 371 (c)(1),
(2) Date: Jan. 19, 2018

(87) PCT Pub. No.: WO2017/015593
PCT Pub. Date: Jan. 26, 2017

(65) Prior Publication Data

US 2018/0209692 A1 Jul. 26, 2018

Related U.S. Application Data

(60) Provisional application No. 62/195,604, filed on Jul. 22, 2015.

(51) Int. Cl.
*F24H 9/20* (2006.01)
*F22D 1/02* (2006.01)
(Continued)

(52) U.S. Cl.
CPC ..... *F24H 9/2021* (2013.01); *F22D 1/02* (2013.01); *F22D 5/26* (2013.01); *F24D 17/0031* (2013.01);
(Continued)

(58) Field of Classification Search
CPC ..... F24H 9/2021; F24H 1/0018; F24H 1/009; F24H 1/102; F24H 1/201; F24H 1/40;
(Continued)

(56) References Cited

U.S. PATENT DOCUMENTS 2,763,764 A 9/1956 Vidalenq
3,315,735 A 4/1967 Stranko
(Continued)

FOREIGN PATENT DOCUMENTS

EP 2937286 A1 10/2015
FR 2 595 137 A1 9/1987
(Continued)

OTHER PUBLICATIONS

Rinnai Hybrid Tank-Tankless Water Heater; Rinnai; Jun. 23, 2016 https://rinnai.us/hybrid-tank-tankless-water-heater/how-it-works.
(Continued)

*Primary Examiner* — Brian W Jennison
(74) *Attorney, Agent, or Firm* — Vorys, Safer, Seymour and Pease LLP; Scott M. Guttman

(57) ABSTRACT

A water heater includes a water tank and a flow-through heating element. The water tank contains heated water. The flow-through heating element is located in the lower portion of the water tank and heats water as water is passed through an interior channel of the heating element. In another configuration, the water heater further includes a recirculation line and the heating element further includes an input end external of the water tank to receive water to be heated and an output end to output heated water into the water tank. The recirculation line transports water from the water tank to the input end of the heating element that is external of the water tank.

20 Claims, 7 Drawing Sheets

(51) Int. Cl.

| | |
|---|---|
| ***F22D 5/26*** | (2006.01) |
| ***F24H 1/10*** | (2006.01) |
| ***F24D 19/10*** | (2006.01) |
| ***F24H 1/20*** | (2006.01) |
| ***F24H 9/00*** | (2006.01) |
| ***F24D 17/00*** | (2006.01) |
| ***F24H 1/00*** | (2006.01) |
| ***F24H 1/40*** | (2006.01) |

(52) U.S. Cl.
CPC ..... *F24D 17/0078* (2013.01); *F24D 19/1051* (2013.01); *F24H 1/009* (2013.01); *F24H 1/0018* (2013.01); *F24H 1/102* (2013.01); *F24H 1/201* (2013.01); *F24H 1/40* (2013.01); *F24H 9/0021* (2013.01); *F24H 2250/00* (2013.01)

(58) Field of Classification Search
CPC .. F24H 9/0021; F24H 2250/00; F24D 11/002; F24D 1/02; F24D 1/08; F24D 17/0078; F24D 3/082; F24D 17/0031; F24D 19/1051
See application file for complete search history.

(56) References Cited

U.S. PATENT DOCUMENTS

| | | | |
|---|---|---|---|
| 3,597,588 | A | 8/1971 | Kirschner et al. |
| 4,257,355 | A | 3/1981 | Cook |
| 4,286,749 | A | 9/1981 | Oguma |
| 4,305,454 | A | 12/1981 | Kaehler |
| 4,506,140 | A | 3/1985 | Armstrong |
| 4,540,874 | A | 9/1985 | Shaffer, Jr. et al. |
| 4,838,211 | A | 6/1989 | Vago |
| 4,949,680 | A | 8/1990 | Kale |
| 5,006,689 | A | 4/1991 | Kurachi et al. |
| 5,092,279 | A | 3/1992 | Barmore |
| 5,647,269 | A | 7/1997 | Miller et al. |
| 5,735,291 | A | 4/1998 | Kaonohi |
| 5,878,192 | A | 3/1999 | Jackson |
| 6,539,173 | B2 | 3/2003 | Chu |
| 6,588,377 | B1 | 7/2003 | Leary et al. |
| 6,628,894 | B2 | 9/2003 | Winter et al. |
| 6,640,047 | B2 | 10/2003 | Murahashi et al. |
| 6,683,283 | B2 | 1/2004 | Schmidt |
| 7,277,628 | B2 | 10/2007 | Giamati |
| 7,298,968 | B1 | 11/2007 | Boros et al. |
| 7,744,007 | B2 | 6/2010 | Beagen et al. |
| 8,225,437 | B2 | 7/2012 | Kurita |
| 8,270,822 | B2 | 9/2012 | Sasaki et al. |
| 8,366,014 | B2 | 2/2013 | Ene et al. |
| 8,581,155 | B2 | 11/2013 | Leary et al. |
| 9,268,342 | B2 | 2/2016 | Beyerle et al. |
| 9,316,412 | B2 | 4/2016 | Giamati |
| 9,335,066 | B2 | 5/2016 | Humphrey et al. |
| 2004/0154786 | A1 | 8/2004 | Lach |
| 2008/0011867 | A1 | 1/2008 | Kayakawa |
| 2009/0188447 | A1 | 7/2009 | Lutz |
| 2010/0218933 | A1* | 9/2010 | Deacon ..... F28D 20/0034 165/285 |
| 2011/0299840 | A1* | 12/2011 | Wielstra ..... F24H 1/142 392/497 |
| 2012/0103958 | A1 | 5/2012 | Wallinger et al. |
| 2014/0003801 | A1* | 1/2014 | Bennett ..... F24H 1/0018 392/449 |
| 2015/0034190 | A1* | 2/2015 | Jebran ..... E03B 7/04 137/565.11 |
| 2015/0110478 | A1 | 4/2015 | Cardoso |
| 2015/0369517 | A1 | 12/2015 | Bourgault et al. |

FOREIGN PATENT DOCUMENTS

| | | |
|---|---|---|
| GB | 266550 | 3/1927 |
| GB | 529662 | 11/1940 |
| GB | 542945 | 2/1942 |
| GB | 2 156 955 A | 10/1985 |
| WO | 1998/57100 A1 | 12/1998 |
| WO | 2001/94861 A1 | 12/2001 |
| WO | 2004/081463 A1 | 9/2004 |
| WO | 08111722 A1 | 9/2008 |

OTHER PUBLICATIONS

International Search Report and Written Opinion. International Application No. PCT/US2016/043651. Forms PCT/ISA/220 and PCT/ISA/237. Authorized Officer: Lee W. Young, dated Oct. 6, 2016.
European Patent Office, Supplementary European Search Report Application No. EP 16 82 8632, Feb. 20, 2019, Munich.

* cited by examiner

HOT WATER TANK

This application claims the benefit of PCT/US2016/043651, filed Jul. 22, 2016, and U.S. Provisional Application No. 62/195,604, filed Jul. 22, 2015.

FIELD OF THE INVENTION

Various configurations of the current invention relate generally to apparatus, systems, and methods for heating water. More particularly, the apparatus, systems, and methods relate to heating water in a water tank. Specifically, the apparatus, systems, and methods provide for heating water with a flow-through heating element located in a lower portion of a water tank.

BACKGROUND OF THE INVENTION

Heated water is customarily provided in commercial aircraft lavatories for hand-washing purposes as well as in galleys for food and hot beverage preparation. There are a number of requirements for such systems that place many limitations on the designs which may be satisfactorily employed. A suitable system should provide needed heated water in as an efficient manner as possible. The amount of electrical power used for heating is limited because aircraft minimize the weight and cost of equipment and the use of less power helps accomplish these goals. It is also desired to keep repair and replacement expenses to a minimum.

One widely-used system accomplishes some of these goals but also has certain deficiencies. That system employs a tank containing two or more electrical heating elements immersed in water. A major shortcoming of that system is that a portion of water is in contact with the heater and is heated to a high temperature, possibly even boiling. This type of water heater may have the undesirable consequence that over time calcification or other impurities form mineral deposits on the heating elements. The deposits are poor thermal conductors and hence, overtime, additional power is required to heat the water. Further, the deposits hasten the need to replace the heating elements or the entire unit. What is needed is a better water heater.

SUMMARY OF THE INVENTION

One embodiment is a water heater that includes a water tank and a flow-through heating element. In operation, the water tank heats water so that it contains heated water. Initially, in one embodiment, the water tank is empty until cold water is introduced to it through a water input line until the tank is filled. The flow-through heating element is located in the lower portion of the water tank, as defined later in the specification, and heats water as volumes of water are passed through an interior of the heating element. In another configuration, the water heater further includes a recirculation line that transports water from the water tank to the input end of the heating element. The heating element may further include an input end to receive water to be heated and an output end to introduce heated water into the water tank.

Another embodiment is a method of heating water in a water tank. The method begins by introducing water to the water tank so that it may be heated with a flow-through heating element. The method next recirculates a volume of water (recirculated water) of the tank. For example, water may be recirculated by allowing it to flow into a bottom end of the flow-through heating element. In another configuration, water recirculation may be performed by extracting water from the water tank with a pipe and flowing the extracted water externally from the water tank and then back into and through the flow-through heating element. This recirculated water then flows through an interior channel of the flow through-heating element that is at least partially located in or near a bottom portion of the water tank. Other embodiments of methods of heating water may heat water above a temperature to kill significant bacteria such as Legionella and unwanted biofilms. In other embodiments, the method may partially cool and/or dilute the heated water when it is removed from the tank with a line of cooler water so that it is safe for the intended use. In another embodiment, water within the water tank may be deflected with an optional deflection plate or other element to promote thermal mixing of the water.

BRIEF DESCRIPTION OF THE DRAWINGS

One or more preferred embodiments that illustrate the best mode(s) are set forth in the drawings and in the following description. The appended claims particularly and distinctly point out and set forth the invention.

The accompanying drawings, which are incorporated in and constitute a part of the specification, illustrate various example methods and other example embodiments of various aspects of the invention. It will be appreciated that the illustrated element boundaries (e.g., boxes, groups of boxes, or other shapes) in the figures represent one example of the boundaries. One of ordinary skill in the art will appreciate that in some examples, one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION OF THE DRAWINGS

Figure 1A:
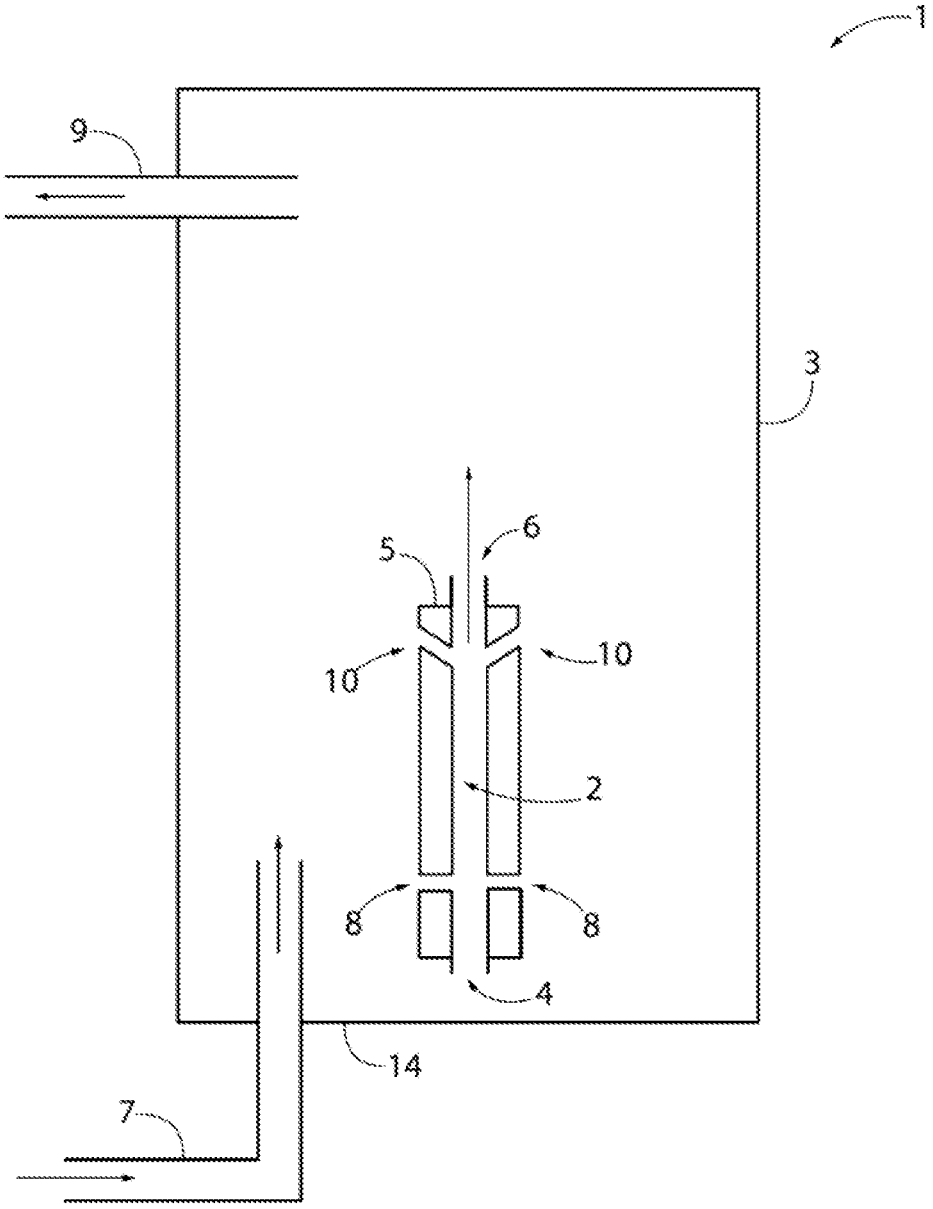
FIG. 1A illustrates a cross-section schematic view of an example first embodiment of a water heater with a flow-through heating element contained within a water tank.

FIG. 1A illustrates a cross-sectional view of a first embodiment of a water heater 1 that includes a water tank 3 and a flow-through heating element 5. Water tank 3 includes an input line 7 for receiving water into water tank 3 from a source of potable water that may be located remote from water heater 1. Initially, when water tank 3 is empty, it may be filled by injecting water into it from input line 7.

Water tank 3 further includes an output line 9 for dispensing heated water from water tank 3. A bottom opening 4 of heating element 5 receives water from tank 3 so that it may be heated and/or reheated by flow-through heating element 5 as the water passes through an interior 2 of the heating element 5 and is re-injected into water tank 3 out of a top opening 6. In some embodiments, flow-through heating element 5 may be a "Watlow" type of inline heater similar to flow-through/inline heaters manufactured by Watlow Electric Manufacturing Company. Additionally, a central tube of the heating element 5 may be a convoluted tube for more efficient heat transfer.

The present invention features a water heater 1 that includes using a flow-through heating element 5 near the base/bottom 14 of water heater 1. In this configuration, heating element 5 is positioned so that its bottom opening 4 is near bottom wall 14 of water tank 3 and the rest of heating element 5 is internal to water tank 3. As discussed below, heating element 5 may be placed in other positions as understood by those of ordinary skill in the art. Positioning heating element 5 near bottom of water tank 3 causes a pressure to be created to recirculate water in water tank 3. This is because the introduction of heated water in this orientation results in the lighter heated water flowing upward toward the top of water tank 3 allowing cooler water to be displaced with this warmer water as the warmer water travels generally upward creating an upward pressure. The upward flowing of heated water that displaces cooler water may act to mix/churn water in water tank 3 so that the water may be more uniformly heated. In some configurations, a fan nozzle may be placed at the upper end of flow-through heating element 5 to disperse heated water as it leaves heating element 5. Other configurations may utilize a directional nozzle at upper opening 6 to direct heated water in a particular direction as it leaves heating element 5 to create a desired circulation between warm and cool water within tank 3. The present invention further utilizes recirculation, temperature differential, and uses positive pressure to heat water rather than simple contacting of a heating coil. The present invention further includes focusing on not increasing surface heating area to heat water but to, rather, running water through flow-through heating element 5 multiple times. Water tank 1 of FIG. 1A may be completely filled to maximize water that may be stored in water tank 1 or, alternatively, provide for a smaller water tank that can hold the same amount of water.

In some configurations, flow-through heating element 5 has an elongated interior channel that acts as a conduit allowing flow-through heating element 5 to heat water as it travels from an input end of this channel upward to an output end of the channel. This allows heating element 5 to act as a thermodynamic pump capable of moving water by temperature differences without requiring moving parts. Heating element 5 creates water velocities within water tank 3 that contribute to the reduction in biofilms and bacteria while promoting efficient thermal mixing within water tank 3. Additionally, a pumping velocity changes as the temperature differential from the input end to the output end of flow-through heating element 5 reaches a maximum heating level. The improved thermal mixing also reduces the recovery time when hot water is drawn from water tank 3. This is a significant improvement over prior art water heaters using tubular heating elements which over time may cause thermal stratification contributing to the breakdown of sanitary conditions inside prior art tanks.

In other configurations, flow-through heating element 5 may have one or more optional lower side openings 8 and one or more optional upper openings 10. Lower openings 8 and or bottom opening 4 may allow cool water to enter heating element 5 near its bottom end and to be heated before exiting upper side openings 10 and/or top opening 6. Those of ordinary skill in the art will appreciate that flow-through heating element 5 may have other openings in other positions and or may have elongated conduits extending from its main elongated interior channel to allow water to be pulled into heating element 5 from other places within tank 3 and for heated water to be distributed to other places within tank 3 to maintain an overall desired circulation pattern within tank 3 between cooler and warmer water. In some configurations, elongated conduits extending from its main elongated interior channel may branch out within water tank 3 with a tree shaped pattern.

Figure 1B:
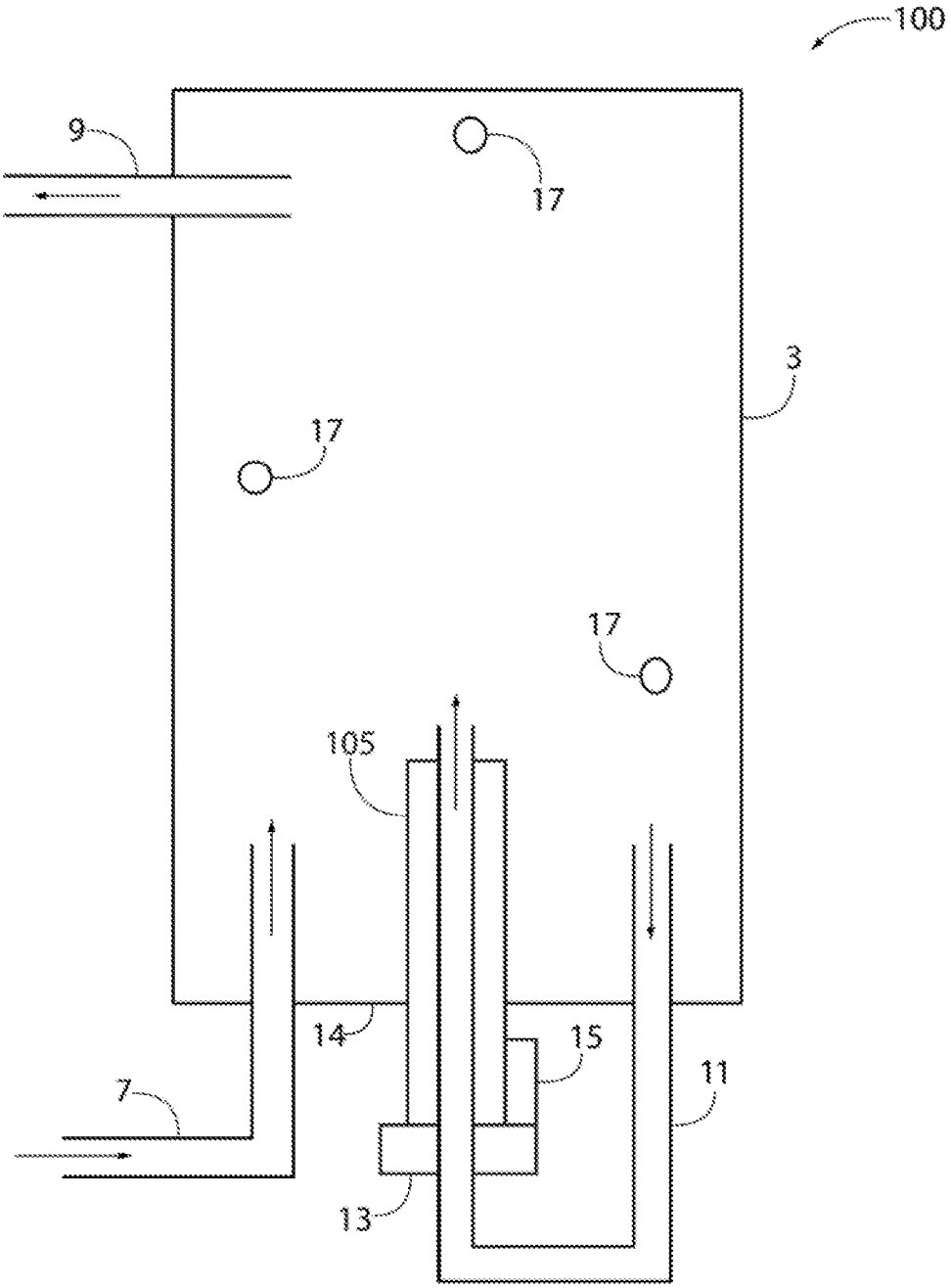
FIG. 1B illustrates a cross-section schematic view of an example second embodiment of a water heater with a flow-through heating element partially extending from a bottom portion of a water tank.

FIG. 1B illustrates another cross-sectional view of a second embodiment of a water heater 100 that also includes water tank 3, a flow-through heating element 105, water input line 7, and output line 9. This configuration additionally includes a recirculation line 11 connected to heating element 105. Recirculation line 11 removes water from water tank 3 and sends it through a flow-through heating element 105 so that it is heated and/or re-heated and re-injected into water tank 3. The present invention features a water heater 100 that includes using a flow-through heating element 105 similar to the heating element of FIG. 1A and that is near the base/bottom 14 of water heater 100. For example, the heating element 105 may be positioned near the base 14 of water heater 100 so that a top end of heating element 105 extends into water tank 3 and a bottom end extends below bottom wall 14 of water tank 3 as illustrated in FIG. 1B. In another configuration, heating element 105 may be positioned so that its top end is near bottom wall 14 of water tank 3 and the rest of heating element 105 is external to water tank 3. As discussed above with reference to FIG. 1A, heating element 105 may be positioned so that its bottom end is near bottom wall 14 of water tank 3 and the rest of heating element 105 is internal to water tank 3. The heating element 105 may be placed in other positions as understood by those of ordinary skill in the art. As previously mentioned and described, positioning heating element 105 near bottom of water tank 3 causes a pressure to be created to recirculate water in water tank 3.

As illustrated in FIG. 1B, some configurations of water heater 100 may include an optional water pump 13 and a controller including control logic 15 to assist flow-through heating element 105 to control a speed that water is recirculated through water tank 3. For example, control logic 15 may evaluate temperatures recorded by different temperature sensors 17 at different locations within water tank 3. During periods of high usage, temperature sensors 17 may detect generally lower temperatures prompting control logic 15 to run pump 13 at a higher speed and/or increasing heat that heating element 105 produces so that more water is heated. Optionally if different temperature sensors 17 record differing temperatures, it may be an indication that water within water tank 3 is not well circulated to, again, cause control logic 15 to run pump 13 at a higher speed and/or increase heat that heating element 105 produces. If temperature sensors 17 detect a temperature above an upper threshold amount, this may cause control logic 15 to turn off or reduce the heat that is produced by heating element 105 and/or to reduce the speed of pump 13 or to turn off pump 13.

"Logic", as used herein, includes but is not limited to hardware, firmware, software, and/or combinations of each to perform a function(s) or an action(s), and/or, to cause a function or action from another logic, method, and/or system. For example, based on a desired application or need, logic may include a software-controlled microprocessor, discrete logic such as an application-specific integrated circuit (ASIC), a programmed logic device, a memory device containing instructions, or the like. Logic may include one or more gates, combinations of gates, or other circuit components. Logic may also be fully embodied as software. Where multiple logical logics are described, it may be possible to incorporate the multiple logical logics into one physical logic. Similarly, where a single logical logic is described, it may be possible to distribute that single logical logic between multiple physical logics.

Water heater 100 may be produced sufficiently small so that it may be provided in commercial aircraft lavatories to provide hot water for such uses as washing hands and galleys for the preparation of hot beverages. Preferably, water heater 100 is made with rigid materials as understood by those of ordinary skill in the art. For example, water heater 100 may be produced using metallic pipes and couplings with water tank 3 formed with rigid metallic walls. In some configurations, water tank 3 may be a seamless plastic tank or a tank formed with other materials as understood by those of ordinary skill in the art.

Figure 2:
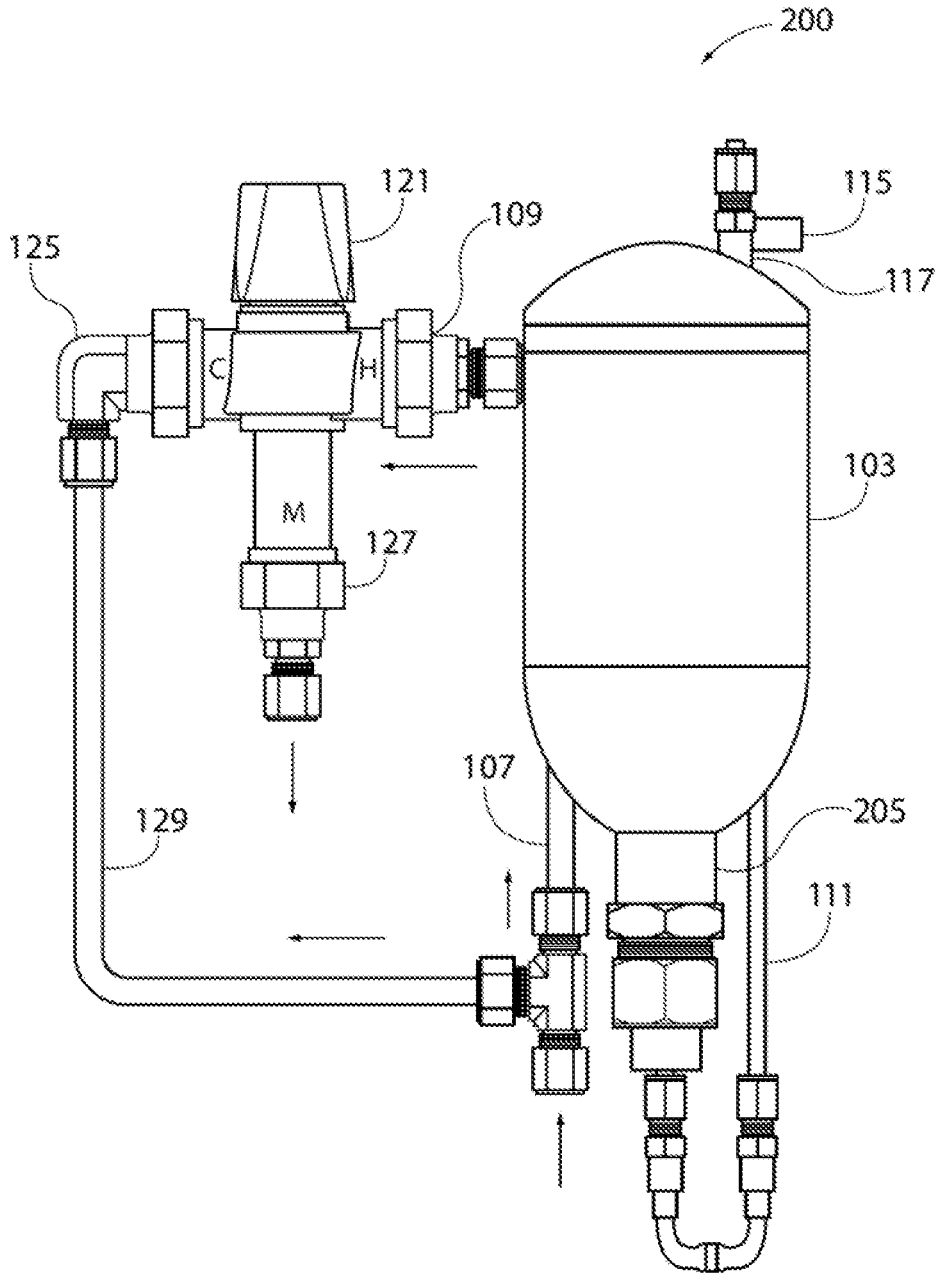
FIG. 2 illustrates a front view of a third embodiment of a water heater.
Figure 3:
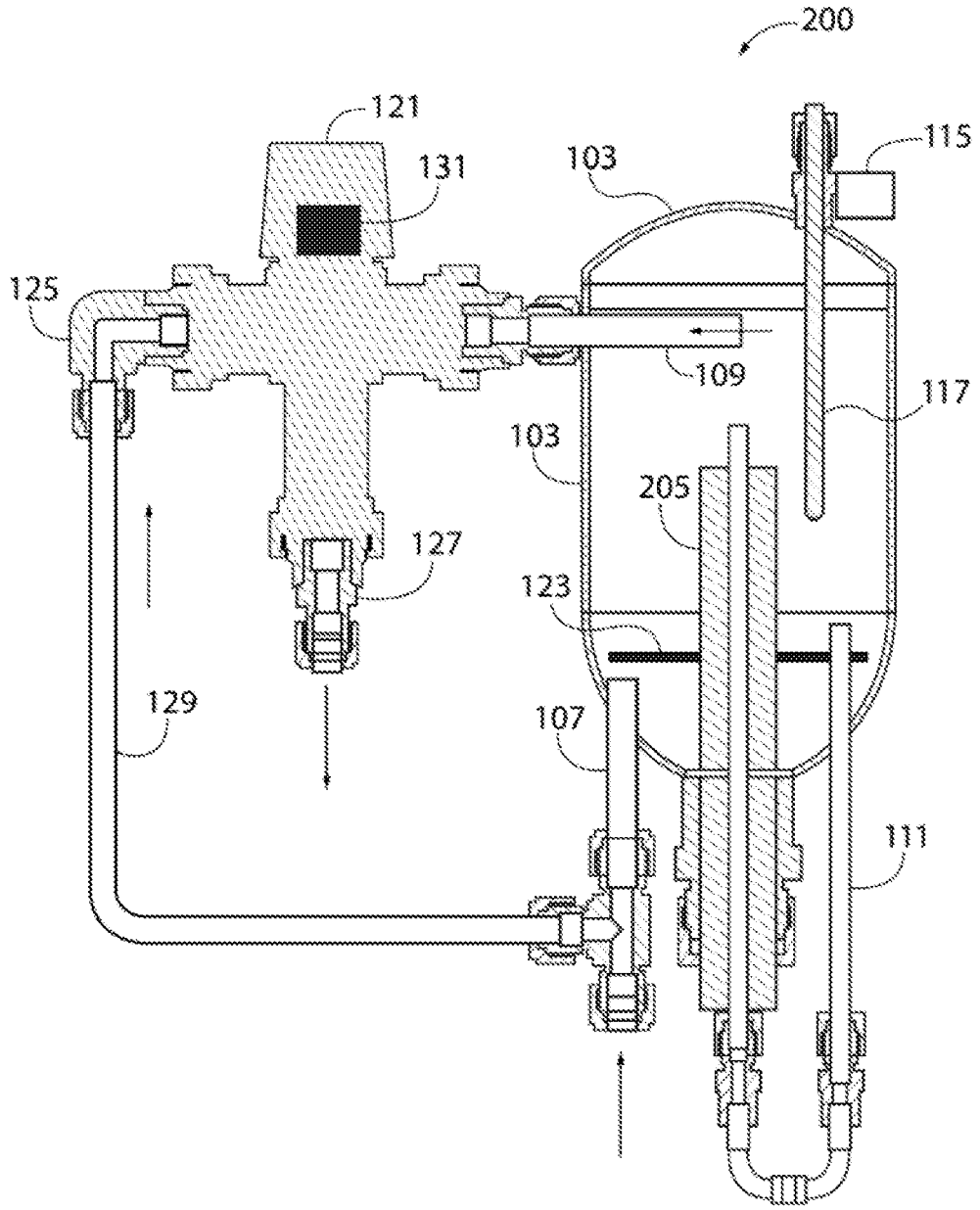
FIG. 3 illustrates a cross-section view of the third embodiment of a water heater.

FIGS. 2 and 3 illustrate a further embodiment of a water heater 200 that in some configurations may be used in aircraft. Similar to water heater 100 of FIG. 1, water heater 200 has a water tank 103, a flow-through heating element 205, a water input line 107, a water output line 109, a water recirculation line 111, and a control logic 115. Water heater 200 further includes a thermocouple 117, a mixing valve 121, and an optional water deflection plate 123. Deflection plate 123 may optionally be a flat water deflection plate with side slots allowing a limited volume of water to past through while water on the other side of deflection plate adjacent to the slots is pulled by water passing through slots to create a churning action. This churning action promotes thermal mixing within the tank while reducing areas for biofilm development and reducing bacterial entrapment within water tank 103. Recirculation line 111 exits near a bottom end of water tank 103 and is injected into a bottom end of heating element 205. In other configurations, recirculation line 111 may exit water tank 103 at other different locations.

Mixing valve 121 may be added to the outlet line 109 external to water tank 103 to prevent personnel from being scalded by the high temperature of water exiting the system. Thus, the outlet line 109 may also serve as an inlet to the mixing valve 121. As understood by those of ordinary skill in the art, mixing valve 121 may be a thermostatic mixing valve and may be adjustable. As illustrated, mixing valve 121 further includes a cold water input line 125 and an output line 127. Mixing valve input line 125 is connected to input line 107 with a T-connector and line 129. Hot water from the output line 109 of the water tank 103 is mixed with cool water from the input line 125 and output through output line 127. Thus, mixing valve 121 may act as an anti-scalding valve that facilitates operation of the hot water tank above temperatures that promote bacterial growth, thus the maintaining of sanitary conditions while protecting hot water users from being scalded.

For example, hot water from water tank 103 after being heated above 131° F. (to reduce bacteria growth) enters mixing valve 121 and is mixed with cold water from input line 125 and exits output line 127 at a lower preset temperature for washing hands or beverage preparation. Keeping heated water in water tank 103 above 131° F. may prevent some bacterial growth and use of mixing valve 121 provides water supplied to the lavatories and galleys of a desired temperature between 95° F. to 115° F. to prevent personnel from being scalded. These temperatures may be consistently achieved during the draw and recovery period by the water heater 200 of FIGS. 2 and 3. It should be appreciated that the described temperatures and temperature ranges are one example and that the water tank 103 may be configured to store and supply water at other suitbale temperatures and temperature ranges, for example, 125° F.

In other configurations, it may be desirable to heat water in tank 103 to a higher temperature than 131° F. to prevent other bacteria growth and to kill existing bacteria. As hot and cold water enters mixing valve 121, in some configurations, an optional thermostat 131 in mixing valve 121 may sense the outlet water temperature. The thermostat 131 reacts by adjusting the incoming amounts of hot and cold water to maintain a stable output temperature. In some mixing valves, a mechanical adjustment of mixing valve 121 allows one to preset the maximum desired temperature.

Thermocouple 117 may sense temperature within water tank 103 and used by a control logic 115 to monitor and control the water temperature inside water tank 103. The functionality of control logic 115 may be similar to the functionality of control logic 15 of FIG. 1B described above. Similar to the water heater 100 of FIG. 1B, flow-through heating element 205 is located near the bottom of water tank 103. Heating element 205 may be placed in other positions as understood by those of ordinary skill in the art. Heating element 205 is commonly a "flow-through" type of heating assembly because, in some configurations, heating element 205 flows water through its entire length during heating. Warmed water exiting heating element 205 creates a pressure head inside water tank 103 which contributes to the thermodynamic pumping action and thermal mixing of water within water tank 103. As previously mentioned, this enables water heater 200 to maintain a generally uniform water temperature within water tank 103 above a predetermined value to maintain sanitary condition within water tank 103.

Figure 4:
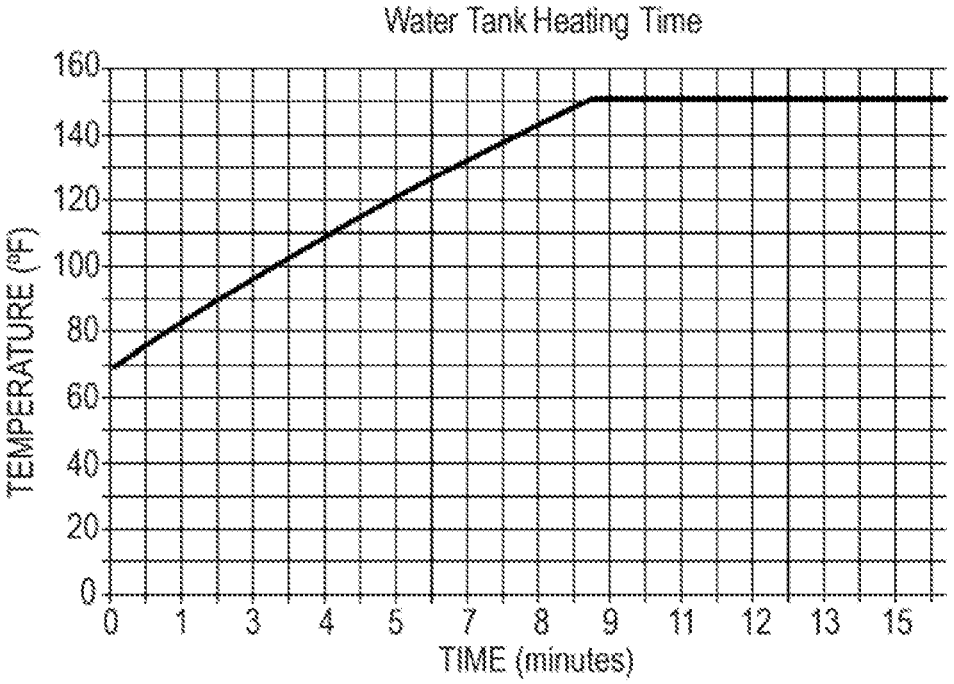
FIG. 4 illustrates the water tank heating time of the third embodiment of a water heater.
Figure 5:
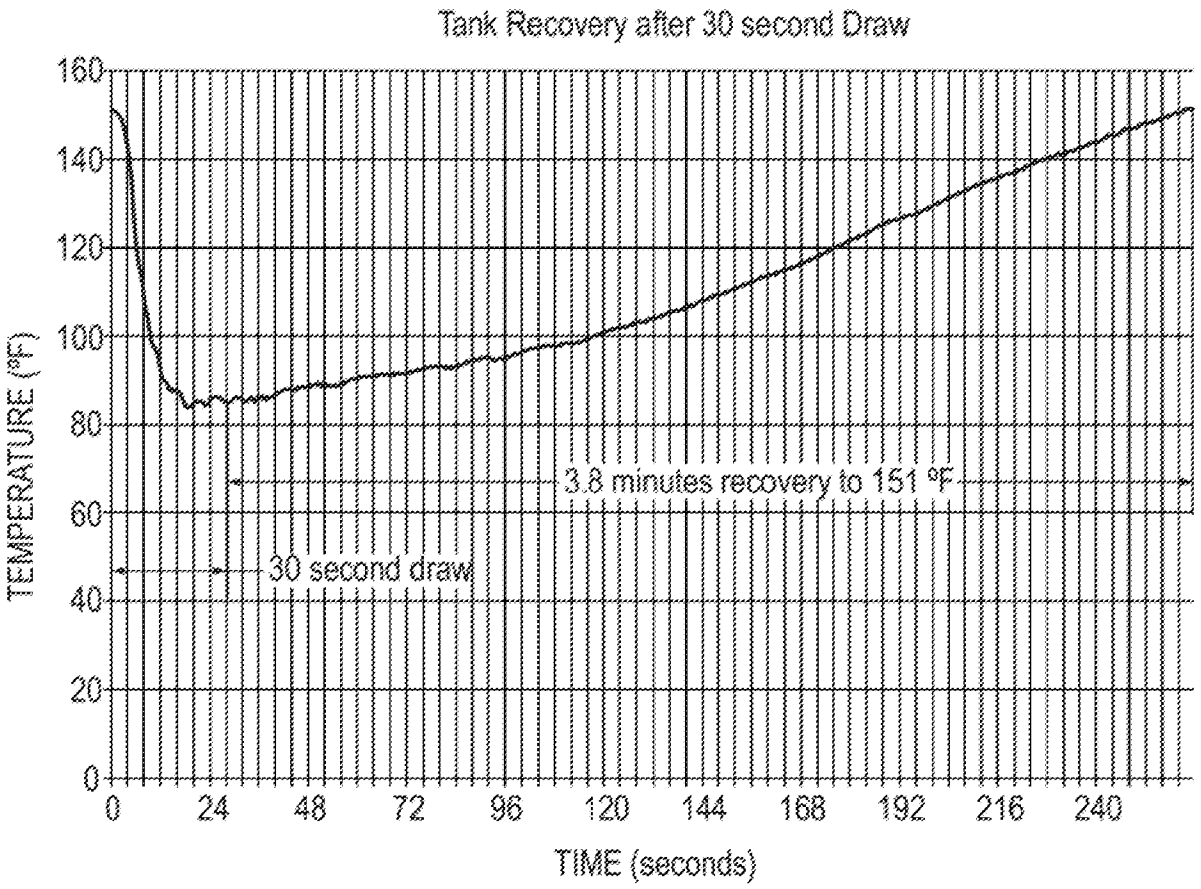
FIG. 5 illustrates the water tank recovery time of the third embodiment of a water heater

Power to the flow-through water heater 205 is controlled to keep the temperature of water in tank 103 nearly constant during both the draw and idle periods. FIG. 4 is an exemplary graph of the initial heating time of water tank 103 with flow-through heating element 205 powered with 410 watts in one embodiment. FIG. 5 is an exemplary graph of the recovery time of water tank 103 with flow-through heating element 205 powered with 410 watts in this same exemplary embodiment.

Example methods may be better appreciated with reference to flow diagrams. While for purposes of simplicity, explanation of the illustrated methodologies are shown and described as a series of blocks. It is to be appreciated that the methodologies are not limited by the order of the blocks, as some blocks can occur in different orders and/or concurrently with other blocks from that shown and described. Moreover, less than all the illustrated blocks may be required to implement an example methodology. Blocks may be combined or separated into multiple components. Furthermore, additional and/or alternative methodologies can employ additional, not illustrated blocks.

Figure 6:
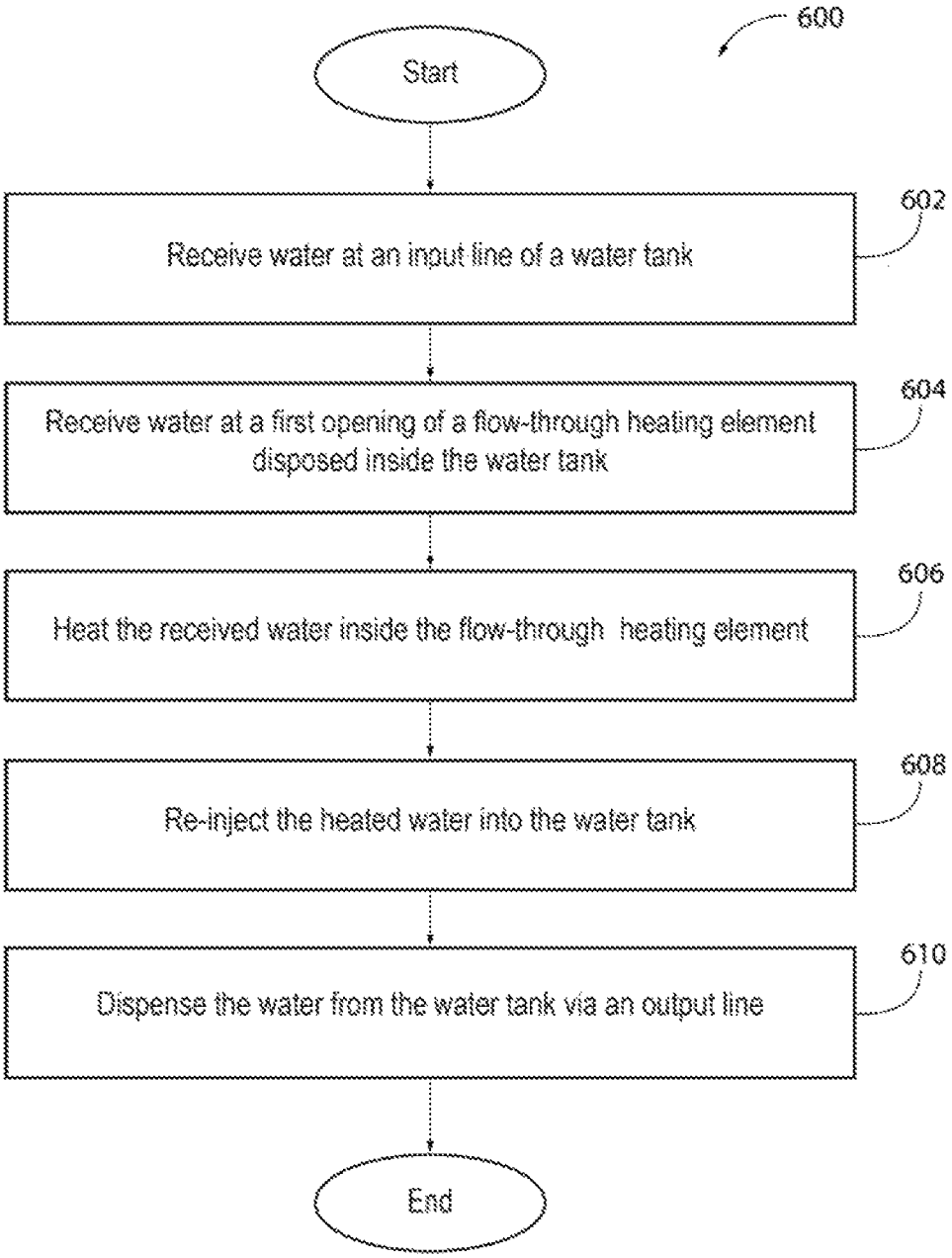
FIG. 6 illustrates another embodiment that is a method of heating water.

FIG. 6 illustrates a method 600 of heating water in a water tank. The method 600 begins by receiving water at an input line of a water tank at 602. In some configurations, a recirculation line may be used to flow water into the heating element as illustrated in FIGS. 1B, 2 and 3 and as discussed above. This recirculated water is then received at a first opening of a flow-through heating element disposed inside the water tank at 604 and heated inside the flow-through element heating element at 606. In one example, the heating element is at least partially located near a bottom portion of the water tank. The heating element may be a flow-through type heating element where water is heated while flowing from an input opening to an output opening of an elongated channel of the heating element. The heated water is the re-injected the heated water into the water tank at 608 and dispensed from the water tank via an output line at 610.

Other embodiments of method 600 may heat water above a temperature to kill bacteria such as Legionella and prevent unwanted biofilms. As discussed above, in other embodiments, method 600 may cool the heated water when it is removed from the tank with a line of cooler water so that it is safe for use. In another embodiment, method 600 may deflect water within the water tank with a deflection plate with openings/slit openings or deflect water in another way to promote thermal mixing of the water.

In the foregoing description, certain terms have been used for brevity, clearness, and understanding. No unnecessary limitations are to be implied therefrom beyond the requirement of the prior art because such terms are used for descriptive purposes and are intended to be broadly construed. Therefore, the invention is not limited to the specific details, the representative embodiments, and illustrative examples shown and described. Thus, this application is intended to embrace alterations, modifications, and variations that fall within the scope of the appended claims.

Moreover, the description and illustration of the invention is an example and the invention is not limited to the exact details shown or described. References to "the preferred embodiment", "an embodiment", "one example", "an example" and so on, indicate that the embodiment(s) or example(s) so described may include a particular feature, structure, characteristic, property, element, or limitation, but that not every embodiment or example necessarily includes that particular feature, structure, characteristic, property, element, or limitation.

What is claimed is:

1. A water heater comprising:

a water tank having an interior volume, comprising:

an input line for receiving water into the water tank; and an output line for dispensing heated water from the water tank; and a flow-through heating element having an elongated channel passing through the bottom wall of the water tank, comprising:

a first opening outside of the water tank for receiving water from the water tank; and a second opening located within the interior volume for re-injecting water heated by the flow-through heating element into the water tank;

wherein the flow-through heating element creates an upward water pressure that induces the flow of water from the first opening to the second opening by the application of heat.

2. The water heater of claim 1, further comprising a recirculation line adapted to transport water from the water tank to the first opening of the heating element.

3. The water heater of claim 2, wherein the recirculation line is adapted to transport water externally from the water tank via an external pipe and to re-inject the water into the water tank via the second opening of the flow-through heating element.

4. The water heater of claim 1, wherein the flow-through heating element is configured to heat the water to a predefined temperature.

5. The water heater of claim 1, further comprising a mixing valve disposed at the output line, the mixing valve comprising a cold water input line and a mixing valve output line and adapted to receive heated water from the water heater at the output line and to mix the heated water with cold water received at the cold water input line before dispensing the water at the mixing valve output line.

6. The water heater of claim 1, wherein the mixing valve comprises a thermostat for measuring a temperature of the water at the mixing valve output line, and wherein the mixing valve is configured to adjust the amount of cold water mixed with the receive heated water from the water heater based on the measured temperature at the mixing valve output line.

7. The water heater of claim 1, further comprising a deflection plate configured to promote thermal mixing of the water inside the water tank.

8. The water heater of claim 1, wherein the interior of the heating element is convoluted.

9. The water heater of claim 1, wherein the heating element if disposed at the bottom of the water tank.

10. The water heater of claim 1, further comprising a fan nozzle disposed at the second opening of the flow-through heating element and configured to disperse heated water as the heated water is re-injected into the water tank.

11. The water heater of claim 10, wherein the fan nozzle is a directional nozzle configured to direct heated water in a predefined direction to create desired circulation.

12. The water heater of claim 1, further comprising one or more side openings disposed on the sides of the elongated channel to allow for water to at least one of enter or exit the heating element.

13. The water heater of claim 1, further comprising at least one sensor disposed in the water tank configured to measure temperature inside the water tank, and wherein the controller including the control logic is configured to regulate the speed at which water is re-circulated based on the measured temperature.

14. A method of heating water comprising:

receiving water at an input line of a water tank;

receiving water at a first opening of a flow-through heating element, the first opening located outside a bottom wall of the water tank;

heating the received water inside the flow-through heating element;

generating an upward water pressure and thereby inducing a flow of water from the first opening to a second opening of the flow-through heating element by the heating of the received water, the second opening located within an interior volume of the water tank;

re-injecting the heated water into the water tank; and dispensing the water from the water tank via an output line.

15. The method of claim 14, further comprising the step of re-circulating water in the water tank by transporting water from the water tank to the first opening of the heating element.

16. The method of claim 15, further including the step of measuring the temperature of the water in the tank and controlling the speed at which water is recirculated based on the measured temperature.

17. The method of claim 14, further comprising the step of mixing the heated water dispensed from the water tank with cold water.

18. The method of claim 17, further comprising the step of measuring the temperature of the water in the water tank and adjusting the amount of cold water mixed with the heated water based on the measured temperature.

19. The water heater of claim 1, wherein the flow-through heating element is an electrical heater.

20. The water heater of claim 1, wherein the flow-through heating element transfers heat to the water through direct contact with the water.

* * * * *